US005709409A

United States Patent [19]

Engel

[11] Patent Number: 5,709,409

[45] Date of Patent: Jan. 20, 1998

[54] MAGNETIC SPIRAL BOUND BOOK

[76] Inventor: Peter H. Engel, 144 N. Robertson Blvd., Los Angeles, Calif. 90048-3102

[21] Appl. No.: 631,617

[22] Filed: Apr. 10, 1996

[51] Int. Cl.[6] ..... B42D 1/00; B42D 3/00; F42F 11/03

[52] U.S. Cl. ..... 281/29; 281/273; 281/45; 281/DIG. 1; 281/38; 402/503

[58] Field of Search ..... 281/15.1, 38, 27.3, 281/45, 29, 35, 31, 3.1, DIG. 1; 402/503, 79; 24/303; D19/26; 206/818

[56] References Cited

U.S. PATENT DOCUMENTS

| | | | |
|---|---|---|---|
| D. 292,598 | 11/1987 | Anastos . | |
| D. 292,599 | 11/1987 | Anastos . | |
| D. 302,699 | 8/1989 | Popat et al. | D19/26 |
| D. 304,343 | 10/1989 | Popat et al. . | |
| D. 321,211 | 10/1991 | Moor . | |
| D. 323,680 | 2/1992 | Fankhauser . | |
| 2,497,332 | 2/1950 | Teetor | 402/503 |
| 2,784,757 | 3/1957 | Bosca et al. | 402/503 |
| 3,975,848 | 8/1976 | Schmid | 40/110 |
| 4,573,821 | 3/1986 | Gilreath | 281/38 X |
| 4,586,729 | 5/1986 | Beylerian | 281/45 X |
| 4,588,209 | 5/1986 | Zebrowski et al. | 285/45 |
| 4,620,725 | 11/1986 | Maehashi | 402/503 X |
| 4,676,527 | 6/1987 | Palmer | 281/30 X |
| 4,819,963 | 4/1989 | Wolski | 281/15.1 |
| 5,328,206 | 7/1994 | Scott | 281/38 |
| 5,366,070 | 11/1994 | Wolov | 206/818 X |
| 5,405,141 | 4/1995 | Wilkes | 273/247 X |

FOREIGN PATENT DOCUMENTS

| | | | |
|---|---|---|---|
| 2141497 | 3/1973 | Germany | 281/DIG. 1 |

*Primary Examiner*—Frances Han

*Attorney, Agent, or Firm*—Fattibene and Fattibene; Arthur T. Fattibene; Paul A. Fattibene

[57] ABSTRACT

This disclosure is directed to a spiral bound book having a permanent magnet incorporated in one of the covers and a complementary weight or magnet incorporated in the opposite cover. The arrangement is such that the spiral bound book is rendered readily displayable or used by magnetic attraction to a magnetically attractive surface whereby the weight or magnet in the opposite cover will cause the book to be displayed in an open position. The individual pages may also incorporate a permanent magnet whereby the respective pages can be maintained or disposed in any selectable open position.

5 Claims, 1 Drawing Sheet

MAGNETIC SPIRAL BOUND BOOK

RELATED APPLICATION

This is a continuation in part of my co-pending application Ser. No. 08/500,537 filed Jul. 11, 1995, entitled "Magnetic Book and Method of Forming Same."

FIELD OF INVENTION

This invention is generally directed to a book construction and more particularly to a spirally bound magnetic book or notebook.

BACKGROUND OF THE INVENTION

Various book constructions are known. However, most of the known book constructions are constructed so as to be displayed in book racks, book cases and/or simply laid on a counter or table top, and a user had to manually open the book to view or read the contents.

It is also known that various types of magnetic holders or designs exist for posting notes onto various magnetic type surfaces, such as metallic bulletin boards, refrigerators and the like. Such known efforts are disclosed in U.S. Design Pat. Nos. 292,598; 292,599; 304,343; 321,211; and 323,680. These design patents disclose various design configurations which include a permanent magnet used to secure a note onto a magnet surface. For the most part, the magnet is formed in the shape of a pleasing animated or inanimate object or configuration.

In my co-pending U.S. application Ser. No. 08/500,537 filed Jul. 11, 1995, incorporated by reference herein, I disclosed a book construction which utilizes a magnet whereby the book is rendered magnetically attracted to a magnetically attractive surface. The arrangement is such that the book could be displayed or supported on a ferrous or metallic surface by magnetic attraction. However, when so displayed or supported, the book was displayed in its closed position. This disclosure is directed to an improved magnetic book construction so as to allow the magnetic book to be displayed or secured to a surface in its open position.

SUMMARY OF THE INVENTION

An object of this invention is to provide a book construction which can be readily displayed or supported upon a metallic surface by magnetic attraction and when so displayed or used, the book automatically assumes an open position so that the contents of the book are rendered visible to the reader.

Another object is to provide a book having a spiral binding and rendered magnetically attractive to a supporting or ferrous surface, so that in the displayed or used position, the book automatically assumes and maintains an open position.

Another object is to provide a spiral bound book which is magnetically attracted to a metallic surface and wherein the pages of the book can be selectively retained in any desired opened position by magnetic attraction.

The foregoing objects and other features and advantages are obtained by a spiral bound book or notebook which includes a permanent magnet incorporated into one cover of the spiral bound book so that it is rendered magnetically attracted to a metallic surface and having the other cover suitably weighted so that when the magnetically attracted cover is adhered to a metal surface with the spiral bound end disposed lower than the open end of the book, the weighted cover will automatically open due to gravity to expose the pages disposed between the covers. The weighted covers may be weighted by any suitable type of weight or by another magnet. The individual pages of the book may also incorporate therein a light magnetic strip or material capable of maintaining the respective pages in any selected predetermined position. The pages of the book may have imprinted thereon any suitable copy, e.g. recipes, household hints, first aid information, blank pages for notes, a calendar, poetry, jokes, quotations, history facts, or any other copy of interest or theme.

IN THE DRAWINGS

DETAILED DESCRIPTION

Figure 1:
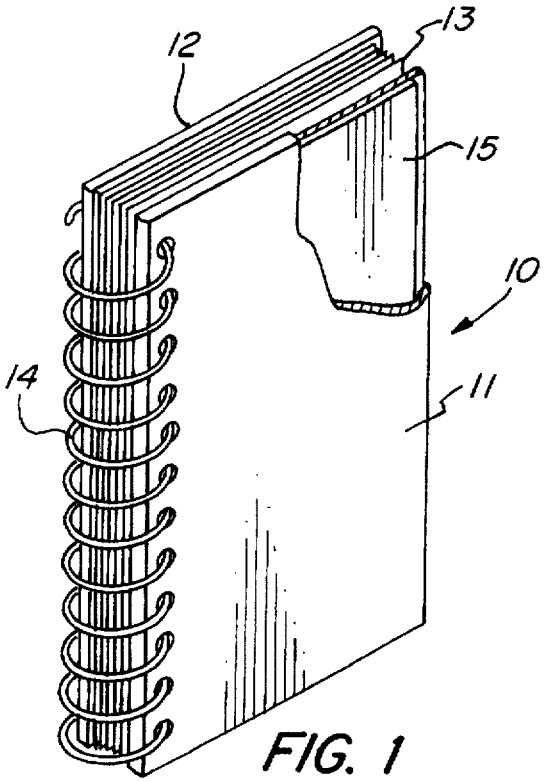
FIG. 1 is a perspective view of a magnetic spiral bound book embodying this invention, and having parts broken away.
Figure 2:
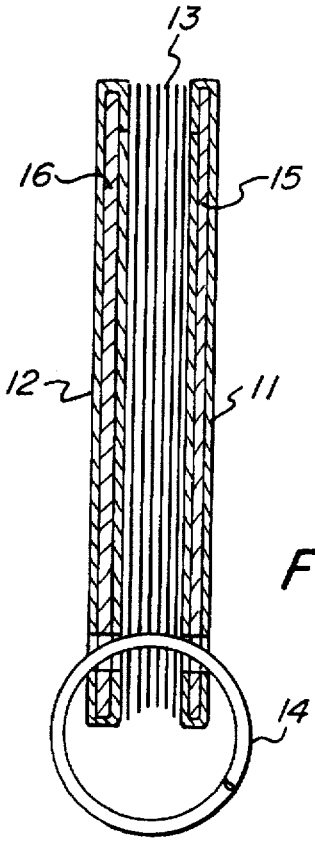
FIG. 2 is a sectional end view of the book construction of FIG. 1.

This is a continuation-in-part application of my co-pending application hereinabove identified and which is incorporated herein by reference.

Referring to the drawings, there is shown in FIGS. 1 to 4 a spiral bound book or notebook 10 embodying the invention disclosed therein. As shown, the book or notebook includes opposed covers 11 and 12 and a plurality of pages 13 disposed therebetween. The book covers 11 and 12 and the pages 13 therebetween are spirally bound in any well known manner by a suitable coiled wire 14 which may be formed of metal or plastic.

In the illustrated form of the invention, at least one cover, e.g., cover 11, has incorporated thereon a permanent magnet 15. The magnet 15 may be imbedded within the cover 11, or may be adhesively or otherwise secured to the inside surface of cover 11. Alternatively, the magnet material may be physically incorporated as magnet particles into material of the cover 11. The arrangement is such so as to make the cover 11 magnetically attractable to a suitable metallic surface "S", e.g., a refrigerator door, a magnetically attractable bulletin board, display rack and the like.

The other cover 12 has incorporated therein a suitable weight 16. The weight 16 may be comprised of any suitable material having sufficient weight so as to enable cover 12 to be influenced by gravity, as will be hereinafter described. The weight imparted to cover 12 may also comprise a permanent magnet similar to that attached to cover 11.

Figure 4:
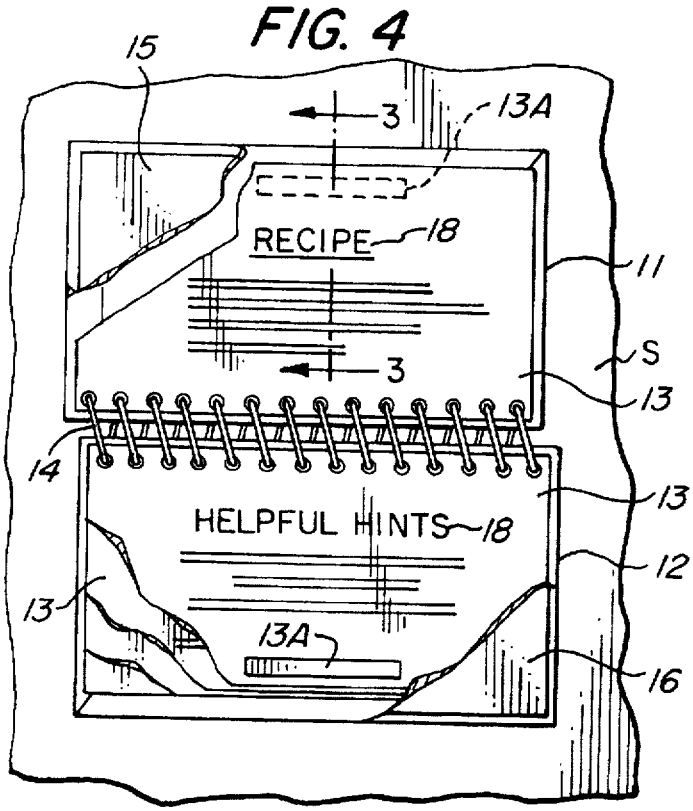
FIG. 4 illustrates the magnetic spiral book embodiment of FIG. 1 in its normally open position when applied to a magnetically attractive surface.

The arrangement is such that when the book or notebook 10 is utilized in its intended position and the cover 11 is rendered magnetically attracted to a metallic surface S, e.g., a refrigerator door, in the position illustrated in FIG. 4, the other cover 12, being weighted by weight 16 or by a magnet similar to that in cover 11, due to gravity, will automatically assume an open book position as shown in FIG. 4.

Figure 3:
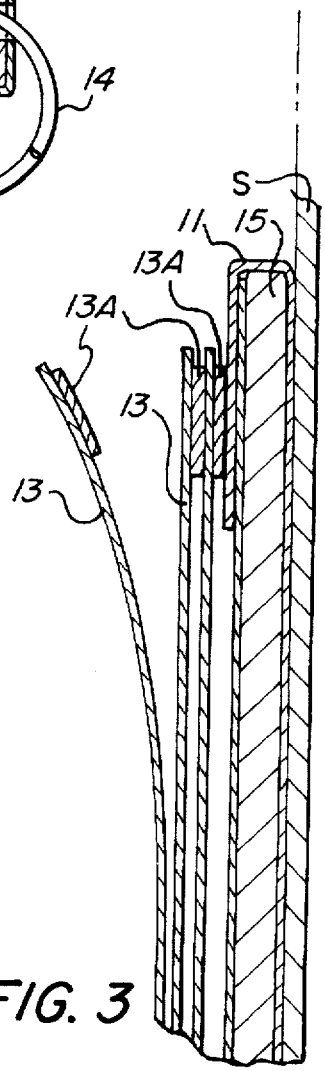
FIG. 3 is an enlarged fragmentary detail of the invention taken along line 3—3 on FIG. 4.

To prevent the individual pages 13 from being randomly influenced by gravity when the book or notebook is attracted to a magnetically attractive surface S, as shown in FIGS. 3 and 4, each page 13 has incorporated therein a small permanent magnet 13A. Alternatively, the pages 13 of the book 10 may have incorporated therein magnetic particles that will render the pages magnetically attracted to one another. With each of the respective pages rendered magnetically attractive to its adjacent page, the reader can open the book to any predetermined page setting, and that setting can be maintained in its selected open position, as seen in FIG. 4, automatically due to the magnetic attraction between the adjacent pages 13.

As shown, the page magnet means 13A are disposed along a respective complementary marginal portion of the respective page so as to overlap one another as best seen in FIG. 3. Thus, to change the page setting, the reader can flip the magnet pages 13 to a desired predetermined open position, and that position will be maintained until a new open position is selected or a page turned. It will be understood that the respective pages 13 may be provided with any suitable text or subject matter of interest, e.g., recipes, poetry, household hints, first aid subjects, a calendar, or any other information or text of a particular given interest. Alternatively, the pages 13 may be blank for notes or shopping lists.

Where the cover 12 is weighted by a non-magnetic weight and cover 11 magnetically attracted to surface "S" with the spirally bounded side of the book disposed horizontally as shown in FIG. 4, the weighted cover 12 is automatically flipped to the open book position. If the opposed covers 11 and 12 are each weighted by a permanent magnet, the book covers can be maintained in the open position in either a vertical open position (not shown) or in the horizontal open position as shown in FIG. 4 by magnetic attraction.

It will be understood that the text 18 imprinted on the respective pages 13 will be placed thereon in the manner in which the book is intended to be used in the open position, so that the text can be readily read by the reader.

From the foregoing, it will be apparent that the magnetic spiral bound book or notebook 10 can be readily applied, e.g., to the front of a refrigerator, and maintained automatically to any predetermined page setting at the selection of the user. The construction comprises a novel kitchen aid and depending upon the text contained therein, constitutes a source of information in a manner not previously contemplated, and which is rendered readily accessible at all times.

While the present invention has been described with respect to the described embodiments, variations and modifications may be made without departing from the spirit and scope of the invention.

What is claimed is:

1. A book construction adapted to be supported on a vertical surface in an open position comprising:

a pair of opposed covers, a plurality of pages disposed between said covers, a spiral binding extending along one edge of said covers and pages therebetween for hingedly binding said covers and pages together, a permanent magnet incorporated in at least one of said covers, a weight incorporated in the other of said covers so that when said cover incorporating said magnet is magnetically attracted to a vertical supporting surface, said spiral binding is extended horizontally along the lower edge of said cover incorporating said magnet, and said cover incorporating said weight under the influence of gravity being automatically disposed to an open book position when said one cover is magnetically supported on a vertically disposed support surface.

2. A book construction as defined in claim 1 wherein said weight includes a permanent magnet.

3. A book construction as defined in claim 1 wherein said pages include a magnet means so that said pages are magnetically attracted to its next adjacent page.

4. A book construction as defined in claim 3 wherein said magnet means are disposed along a complementary edge of each of said pages.

5. In a book construction as defined in claim 3 wherein said page magnet means of said respective pages being contiguously disposed relative to the page magnet means of the next adjacent page so that said pages are magnetically attracted to its next adjacent page for maintaining said pages in a selectable predetermined open position.

* * * * *